United States Patent [19]

Moore

[11] 4,015,580

[45] Apr. 5, 1977

[54] SAFE HEATER

[76] Inventor: Leonard V. Moore, 602 Redfield Ave., Los Angeles, Calif. 90042

[22] Filed: Dec. 10, 1975

[21] Appl. No.: 635,434

[52] U.S. Cl. ..... 126/65; 126/9 R; 126/82

[51] Int. Cl.[2] ..... F24B 3/00

[58] Field of Search ..... 126/9 R, 15 R, 4, 58, 126/64, 65, 82

[56] References Cited

UNITED STATES PATENTS

| | | | |
|---|---|---|---|
| 311,143 | 1/1885 | Pickering | 126/82 |
| 1,190,396 | 7/1916 | Frazer | 126/58 |
| 1,383,043 | 6/1921 | Weaver | 126/4 |
| 1,961,423 | 6/1934 | Long | 126/4 |
| 2,428,183 | 9/1947 | Sveda | 126/4 |
| 3,547,097 | 12/1970 | Rice et al. | 126/4 |
| 3,952,721 | 4/1976 | Patterson | 126/4 X |

*Primary Examiner*—William E. Wayner
*Assistant Examiner*—William E. Tapolcai, Jr.

[57] ABSTRACT

This device consists primarily of a lightweight base to which by leg members, is secured adjustably, a firebox above which is the main heating chamber. The device includes an external pipe with a damper for introducing air into the breathing chamber for burning charcoal or other fuel. The fresh air pipe of the device is secured fixedly to the upper air intake pipe which encircles the exhaust pipe of the device, the exhaust pipe being extended through a window or other opening within a dwelling.

3 Claims, 2 Drawing Figures

SAFE HEATER

This invention relates to portable heating devices, and more particularly to a safe heater.

It is therefore the principal object of this invention to provide a safe heater which will use wood, charcoal, briquets and other fuels for heat.

Another object of this invention is to provide a heater which will be particularly adaptable for campers. Many people do not realize that charcoal briquets are dangerous when burned in an enclosed area and this invention serves to eliminate such danger.

Another object of this invention is to provide a heater of the type described which will be adaptable for use in cabins and it will be very light in weight so as to be readily portable.

A further object of this invention, is to provide a heater which will be of such structure, so as to be adaptable for use with other type fuels, such as gasoline, kerosene, etc., by attaching the burners inside while having the fuel, supplying the burners, a safe distance away.

Other objects of the invention are to provide a safe heater which is simple in design, inexpensive to manufacture, rugged in construction, easy to use and efficient in operation.

These and other objects will be readily evident upon a study of the following specification and the accompanying drawing, wherein.

Figure 1:
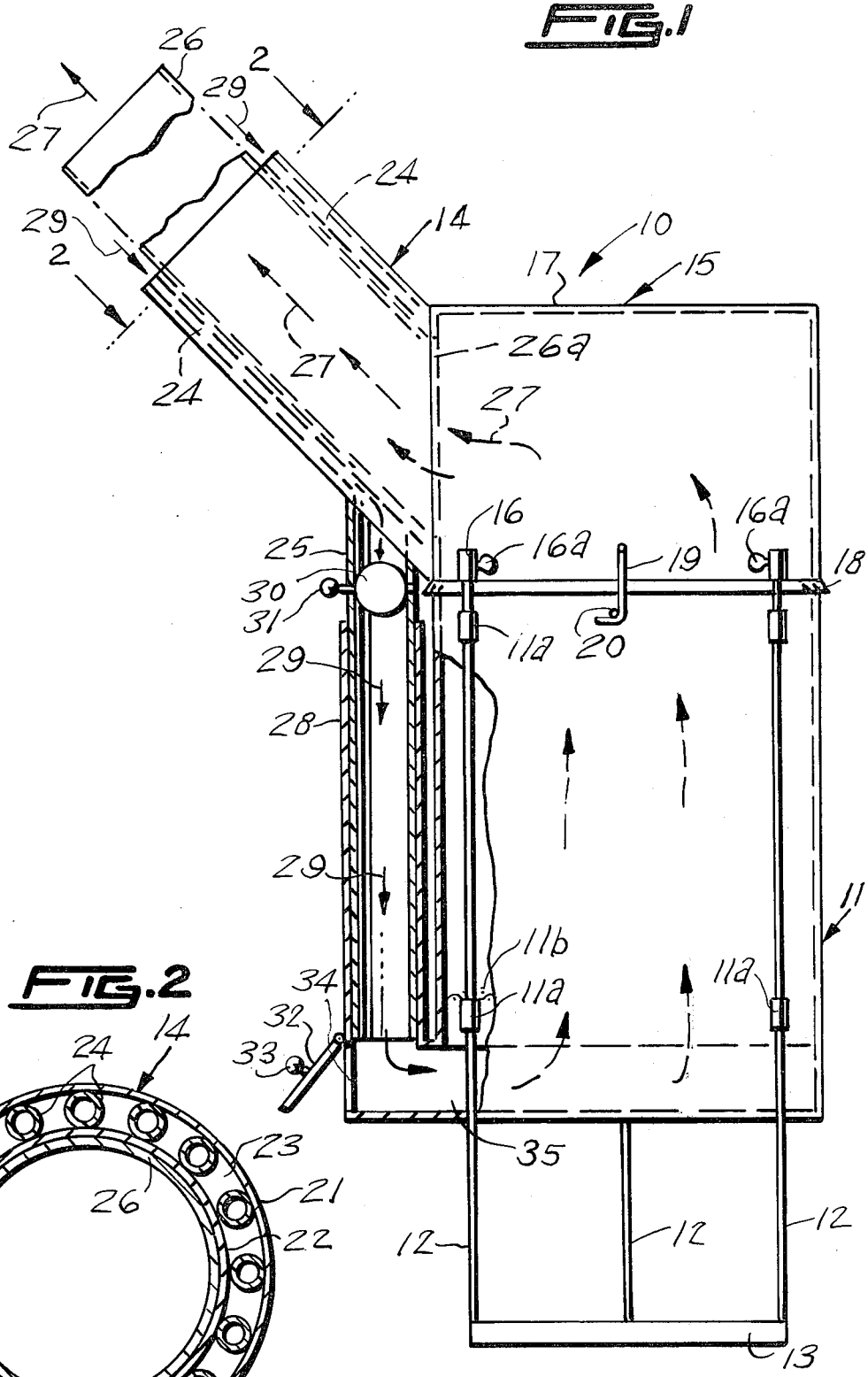
FIG. 1 is a side view of the present invention shown in elevation and partly broken away.
Figure 2:
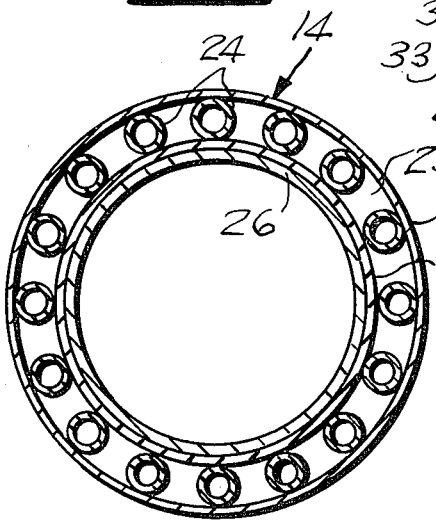
FIG. 2 is an enlarged transverse view taken along the line 2—2 of FIG. 1, showing the air intake and exhaust arrangement.

According to this invention, a heater 10 is shown to include a plurality of equally spaced apart legs 12 which are secured fixedly, at one end, to a base 13. Heater 10 is provided with an air intake pipe 14 which is fixedly secured at an off-set angle, to main heating chamber 15. Secured fixedly to the exterior of heating chamber 15, are a plurality of spaced apart sleeves 16 having set screws **16*a* which will render chamber 15 stationary to the legs 12 of base 13. The top wall 17 of heating chamber 15 is of heavy gauge material for cooking purposes. The open end of heating chamber 15 is provided with an outwardly flared edge 18 for receiving a similar but inwardly flared portion of the open end of fire box 11, the fire box 11 being adjustable upwards and downwards. The fire box 11 is provided with a plurality of sleeves 11*a* which are fixedly secured to the exterior of fire box 11, the sleeves 11*a* receiving the legs 12 of base 13. A grill 11*b* of wire or other suitable material, is secured fixedly to the interior peripheral wall surface of fire box 11.**

Latch means 19 is pivotably secured to the exterior of heating chamber 15 and provides a means of being removably engaged with extending pin means 20 of fire box 11. Air intake pipe 14 consists of double walls 21 and 22 which define an annular space 23. Between double walls 21 and 22 is fixedly secured a plurality of equally spaced apart tubes 24. Received on the interior of air intake pipe 14, is external pipe 25 which is spaced apart from and extends downwards of fire box 11.

Extending from air intake pipe 14, is exhaust pipe 26 which abuts with opening **26*a* of the main heating chamber 15 and the flow of the exhaust gases are indicated by the arrows 27. Pipe 25 is slideably received within pipe 28 which is fixedly secured to fire box 11 and the flow of outside air is indicated by the arrows 29. The extending portion of exhaust pipe 26 is suitably placed so that it extends outside of the dwelling in which heater 10 is used. Fire box 11 is freely elevatable and when it is all the way downwards, there is sufficient space between fire box 11 and heating chamber 15 for feeding more fuel into fire box 11. After fire box 11 is fed sufficiently, it is raised to heating chamber 15 and is latched by the latch 19 and pin 20** means.

It shall be noted that a foot pedal system may be adapted to device 10 for the lowering and raising of fire box 11. For venting of device 10, the pipes 14 and 26 may be extended out of a window and the open space covered with sheet metal. The exterior of the air intake pipe 14 does not become hot enough to become a fire hazard and the lower extremity of device 10 is cooled by fresh air.

The damper valve 30 is pivotably secured within pipe 25 and is provided with an extending knob 31 for adjustment means thereof, so as to control the fresh air flow. The fresh air flow as indicated by the arrows 29, provides the oxygen for the burning of the fuel received within fire box 11 and at the lower extremity of pipe 28, is pivotably secured a hinged door 32 having a knob 33 for opening it. Door 32 serves as cover means for the opening 34 of the breathing chamber 35.

What I now claim is:

1. A heater for the burning of fuels indoors, comprising, a base, a plurality of equally spaced apart legs secured to said base, a fire box elevatable on said legs of said base, a main heating chamber supported on said legs of said base, intake air and exhaust pipe means secured to said main heating chamber, and air intake pipe means secured to said fire box, wherein said exhaust pipe is secured fixedly over the opening in the side wall of said main heating chamber and said air intake pipe is secured on the outer periphery of said exhaust pipe, fixedly, and said air intake pipe intersects and is secured fixedly to air intake pipe means slideably received within an external pipe secured fixedly to said fire box, said intake pipe means slideably received therein, having adjustable damper valve means which controls the flow of fresh air into a breathing chamber secured fixedly to the bottom of said fire box, said breathing chamber having hinged door means for covering and uncovering said breathing chamber, said air travelling through fuel support means secured fixedly within said fire box.

2. The combination according to claim 1, and a plurality of sleeve members are fixedly secured to the exterior wall of said fire box, said sleeves slideably receiving said legs, said fire box being lowered from said main heating chamber which defines opening means being between flanged ends of said fire box and said heating chamber for receiving fuel upon said grill means within said fire box.

3. The combination according to claim 2, wherein a plurality of spaced apart sleeves are secured fixedly to the outer periphery of said heating chamber, said sleeves having set screw means for rendering said heating chamber stationary up on said legs of said device, and said air intake pipe of said heating chamber consists of a pair of spaced apart walls between which are fixedly secured, a plurality of equally spaced apart tubes, said tubes intersecting said pipe with valve control means and said heating chamber is provided with external latch means pivotably secured to the external periphery of said heating chamber and the opposite end removably receives pin means fixedly secured to the exterior of said fire box.

* * * * *